United States Patent [19]

McClocklin

[11] 4,145,957

[45] Mar. 27, 1979

[54] PILOT-OPERATED VALVE STRUCTURE

[75] Inventor: Samuel B. McClocklin, Owatonna, Minn.

[73] Assignee: Owatonna Tool Company, Owatonna, Minn.

[21] Appl. No.: 834,059

[22] Filed: Sep. 16, 1977

[51] Int. Cl.[2] ..... F15B 11/16; F15B 13/06

[52] U.S. Cl. ..... 91/508; 91/521; 137/596.14; 137/625.66; 91/461

[58] Field of Search ..... 91/413, 461, 468, 411 R; 137/596.14, 596.15, 596.16, 625.66

[56] References Cited

U.S. PATENT DOCUMENTS

| | | | |
|---|---|---|---|
| 2,390,425 | 12/1945 | Crum | 91/464 X |
| 2,880,708 | 4/1959 | Hayner | 91/464 X |
| 3,016,917 | 1/1962 | Hunt | 137/625.27 |
| 3,129,645 | 4/1964 | Olmsted | 91/461 |
| 3,162,212 | 12/1964 | Leding | 137/596.15 X |
| 3,220,318 | 11/1965 | McGuire | 91/461 |
| 3,358,964 | 12/1967 | Cohen et al. | 137/505.18 X |
| 3,376,792 | 4/1968 | Clarke et al. | 137/505.18 X |
| 3,934,610 | 1/1976 | Solie | 137/596.16 X |

FOREIGN PATENT DOCUMENTS

| | | | |
|---|---|---|---|
| 984180 | 2/1965 | United Kingdom | 137/625.27 |

*Primary Examiner*—Edgar W. Geoghegan
*Attorney, Agent, or Firm*—Wegner, Stellman, McCord, Wiles & Wood

[57] ABSTRACT

A pilot-operated valve structure for controlling high pressure fluid flow relative to a pair of cylinders, each having an extend port and a retract port. The valve structure has a pair of pilot-operated 3-way valves, each with a poppet valve member and with pilot valve structure including pilot lines directed to the 3-way valves and to the retract ports of the cylinders. The pilot valve has multiple positions including a neutral position whereby pilot pressure may be directed to the 3-way valves for positioning thereof and to the retract ports of the cylinder for holding the pistons in the cylinders retracted or causing retraction of a piston of an extended cylinder. Two alternate positions of the pilot valve cause positioning of one or the other of the 3-way valves to cause extension of the piston in the associated cylinder while the piston in the other cylinder is maintained in retracted position.

7 Claims, 5 Drawing Figures

PILOT-OPERATED VALVE STRUCTURE

CROSS-REFERENCE TO RELATED APPLICATION

A 4-way valve utilizing a pair of 3-way valves and having additional valve structure including a pilot valve and a pressure-reducing valve is shown in the copending application of Samuel B. McClocklin et al, Ser. No. 644,530, filed Dec. 29, 1975, now U.S. Pat. No. 4,083,381, issued Apr. 11, 1978. This prior application includes reference to prior art respecting valve components manufactured by the assignee of the aforesaid application and this application.

BACKGROUND OF THE INVENTION

This invention relates to a pilot-operated double 4-way valve for controlling the flow of a relatively high pressure fluid from a single source to an extend port of either of a pair of cylinders with low pressure pilot fluid used for cylinder retraction.

The use of 4-way valves to control flow to one or more cylinders is known in the art. Such valves are normally only available for handling fluid pressures up to a value approximating 5,000 psi. A conventional type of 4-way valve with a valve spool will not operate reliably in a system where the fluid pressures may approximate 10,000 psi.

In overcoming the foregoing, this invention utilizes a pair of pilot controlled 3-way valves related to provide a 4-way valve, with selective delivery of high pressure fluid to either one of two cylinders for causing extension of a piston in the cylinder and with utilization of low pressure pilot fluid for retraction of a piston in a cylinder and maintenance of the pistons in the cylinders in retracted position.

The assignee of this application has, for many years, manufactured a 4-way valve having a pair of 3-way valve components and with positioning thereof under the control of a solenoid-operated pilot valve. This prior valve did not have a construction to provide for control of one or the other of a pair of cylinders by a pilot valve having pilot lines with pilot fluid also being used to retract pistons in the cylinders.

An additional prior construction of the assignee of this application is shown in the copending application referred to above, with a 4-way valve structure having a pair of 3-way valves associated with a single cylinder and with means for holding pressure. However, the pilot fluid was not directly utilized in conjunction with positioning of the piston of the cylinder.

SUMMARY OF THE INVENTION

A primary feature of the invention disclosed herein is to provide a pilot-operated, double 4-way valve for controlling the operation of a pair of cylinders, each having an extend port and a retract port by selective connection of a cylinder extend port to a source of high pressure fluid and use of low pressure pilot fluid for retraction to and maintenance of the pistons in the cylinders in retracted position.

With the valve structure disclosed herein, it is possible to operate either of two cylinders independently up to pressures approximating 10,000 psi with the high pressure being required to act on the pistons in the cylinders in only one direction of movement and with low pilot pressure being used to operate the pistons in the cylinders in the other direction. This enables use of the valve in association with high pressure pumps for operating hydraulic tools, such as crimping, staking, riveting, etc., wherein the usual circuit requirements require advance of a piston of a cylinder and development of high pressure with retraction at a relatively low pressure and shut-off operation.

In carrying out the foregoing, the 4-way valve has a pair of 3-way valves, each with a poppet valve member and a pilot piston for controlling the position of the valve member whereby pilot fluid pressure maintains the valve member in a position to block high pressure fluid from an extend port in a cylinder and is directed to the retract ports of the cylinders to maintain the pistons in the cylinders in retracted position. A pilot valve has multiple positions, with one position thereof directing pilot fluid to both pilot pistons and to the retract ports of the cylinders to retract an extended piston of a cylinder or maintain the pistons in the cylinders in retracted position. Two alternate positions of the pilot valve each remove pilot fluid from one pilot piston and one retract port whereby high pressure fluid may be directed to an extend port for extension of a piston in a cylinder.

DESCRIPTION OF THE PREFERRED EMBODIMENT

Figures 1, 1A:
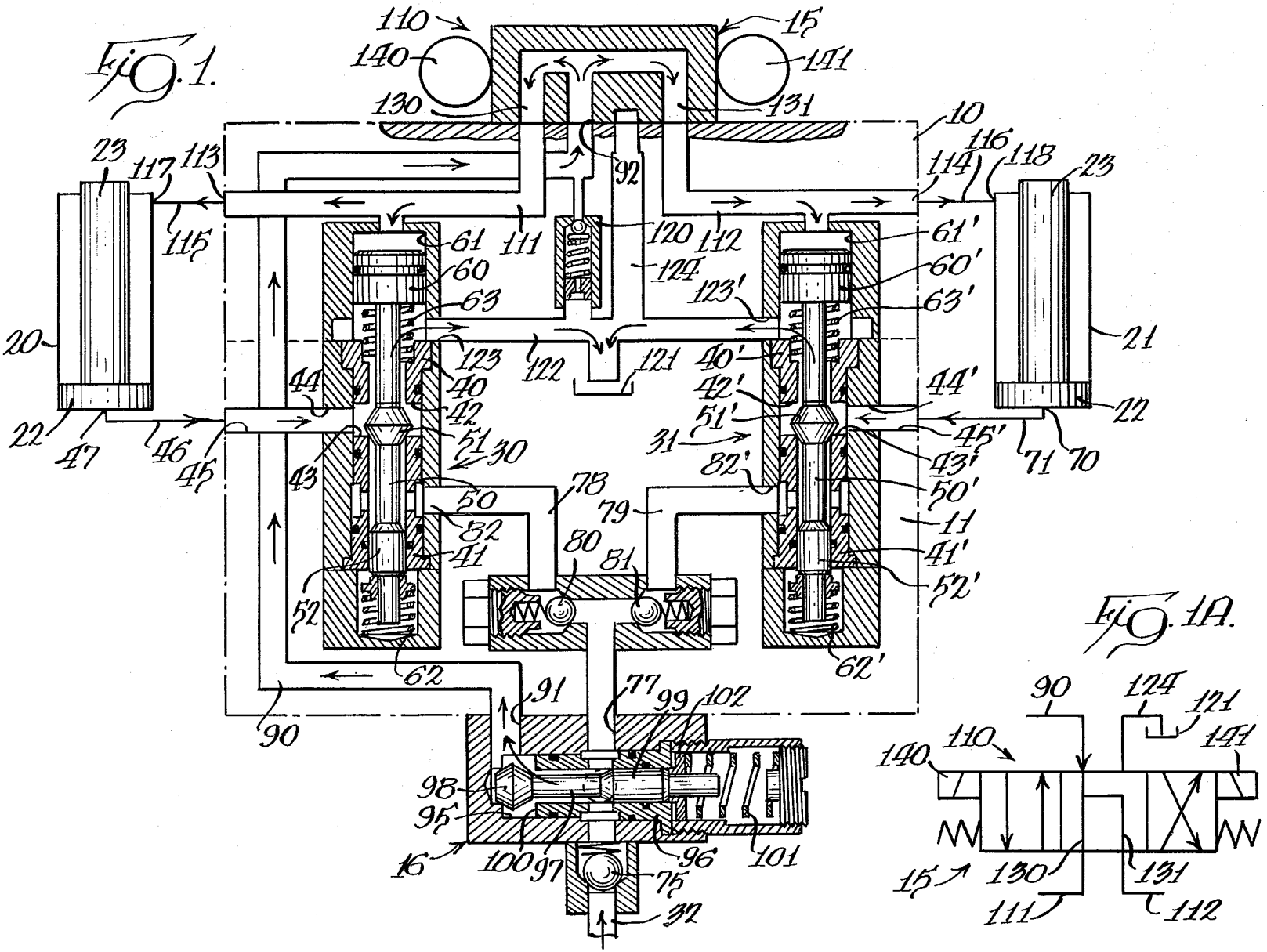
FIG. 1 is a schematic view of the pilot-operated 4-way valve shown connected to a pair of double-acting cylinders and with the major valve components shown in section.
FIG. 1A is a symbol view, showing the pilot valve and connections thereto.

The valve is shown particularly in FIG. 1 as having a plurality of body sections with a pilot cylinder body 10, shown in association with a main body section 11 and both indicated in broken line. The pilot cylinder body 10 has a pilot valve, indicated generally at 15, associated therewith. A pressure reducing valve, indicated generally at 16, is adjacent the main body section 11.

The valve is shown in association with a pair of double-acting cylinders 20 and 21 for control thereof. Each of the cylinders has a piston 22 and piston rod 23 for movement between a retracted position, shown in FIG. 1, and an extended position with the rod 23 extended outwardly from the cylinder and as shown for the rod 23 of cylinder 21 in FIG. 2.

The valve includes a pair of 3-way valves, indicated generally at 30 and 31, for controlling the flow of high pressure fluid from a line 32 to the cylinders 20 and 21. The structure of the 3-way valve 30 will be described in detail and the corresponding structure of the 3-way valve 31 is given the same reference numeral with a prime affixed thereto. The 3-way valve 30 has a pair of sleeves 40 and 41 fitted within a bore of the main body section 11 with the spaced-apart facing ends thereof defining first and second valve seats 42 and 43, respectively, and which are positioned to either side of a control port 44 which communicates with a passage 45 in the main body section 11. The control port 44 is connectable to a line 46 leading to an extend port 47 of the cylinder 20.

A valve member 50 is movable within the sleeves 40 and 41 and has a poppet valve member 51 with a pair of oppositely-extending frusto-conical sections with a lower section thereof seated against the valve seat 43, as viewed in FIG. 1. In the position of FIG. 1, the valve member is balanced in closed position by means of a land 52 at the lower end of the valve spool. The position of the valve member is under the control of a pilot piston 60 mounted in a pilot cylinder 61 in the pilot cylinder body 10, with the valve member being urged upwardly by a spring 62 and the pilot piston being urged upwardly by a spring 63. With low pressure pilot fluid directed to the pilot cylinder 61, the resulting force acting on the pilot piston 60 overcomes the force of the springs 62 and 63 to urge the valve member to the position shown in FIG. 1. Upon release of the pilot fluid pressure, the springs are operative to raise the valve member from the position shown to have the upper section of the poppet valve member 51 seated against the valve seat 42.

The control port 44' of the 3-way valve 31 is connectable to an extend port 70 of the cylinder 21 by a line 71.

High pressure fluid is delivered by a pump capable of operation up to a pressure of approximately 10,000 psi (not shown) through a supply line 32 past a check valve 75 which connects to the pressure-reducing valve 16. As outlet passage 77 from the pressure-reducing valve leads to a pair of branch lines 78 and 79, each having a non-reverse flow check valve 80 and 81, respectively, with the branch lines 78 and 79 connecting into respective inlet ports 82 and 82' of the 3-way valves and with passages through the sleeves 41 and 41' to the interior of the valves. With the poppet valve members 51 and 51' positioned as shown in FIG. 1, the high pressure fluid cannot reach the extend ports 47 and 70.

A low pressure fluid pilot circuit includes a primary pilot line 90 extending from an outlet port 91 of the pressure-reducing valve 16 to a port 92 of the pilot valve 15.

The pressure-reducing valve has a bore 95 mounting a sleeve 96 in which a valve spool 97 is movable. The valve spool 97 has a double frusto-conical end 98 with the right-hand side thereof providing a poppet valve member and together with a balancing land 99 the poppet valve member is balanced when shifted toward the right, as viewed in FIG. 1, to close against a valve seat 100 formed by an end of the sleeve 96. The valve spool 97 is normally urged to the position shown by a spring 101 whereby fluid may flow from the supply line 32 to the pilot fluid port 91. The spring 101 acts through a ring 102 associated with the valve spool to set the maximum value of the pilot pressure. As the pilot pressure builds up to a value sufficient to act on the left-hand side of the poppet valve member 98 and overcome the force of the spring 101, the pressure reducing valve will move to a closed position and maintain this position with the balanced relation of the poppet valve member and land 99 whereby pressure can build up for supply through the branch lines 78 and 79 of use in extending the piston in one of the cylinders 20 and 21.

The pilot valve 15 is a 3-position, 4-way valve having a neutral position shown in FIGS. 1 and 1A wherein the primary pilot line 90 is connected to a pair of pilot lines 111 and 112 in the pilot cylinder body 10 which connect, respectively, to the pilot cylinders 61 and 61', and which also extend to body ports 113 and 114 which are connectable by lines 115 and 116 to retract ports 117 and 118 of the cylinders 20 and 21, respectively. The primary pilot line 90 has a safety relief valve 120 connected into circuit therewith, with the outlet of the safety relief valve connected to a reservoir 121 by a drain line 122 which also extends between reservoir ports 123 and 123' of the 3-way valves 30 and 31. The drain line 122 also connects to a reservoir line 124 which extends to a port of the pilot valve 15.

In the neutral, or retract, position of FIG. 1, the pilot valve 15 is in a spring-centered, neutral position whereby the primary pilot line 90 connects to the pilot lines 111 and 112 through the pilot valve passages 130 and 131. This directs pilot pressure to the retract ports 117 and 118 of the cylinders and also to the pilot cylinders 61 and 61' to urge the pilot pistons and associated valve members to the position shown in FIG. 1. Supply pressure from supply line 32 can reach the bores of the 3-way valve members 30 and 31. However, there is a balance of forces because of the balancing lands 52 and 52' associated with the poppet valve members of the 3-way valves, so that there is no force tending to move the poppet valve members from their seats.

Figure 2:
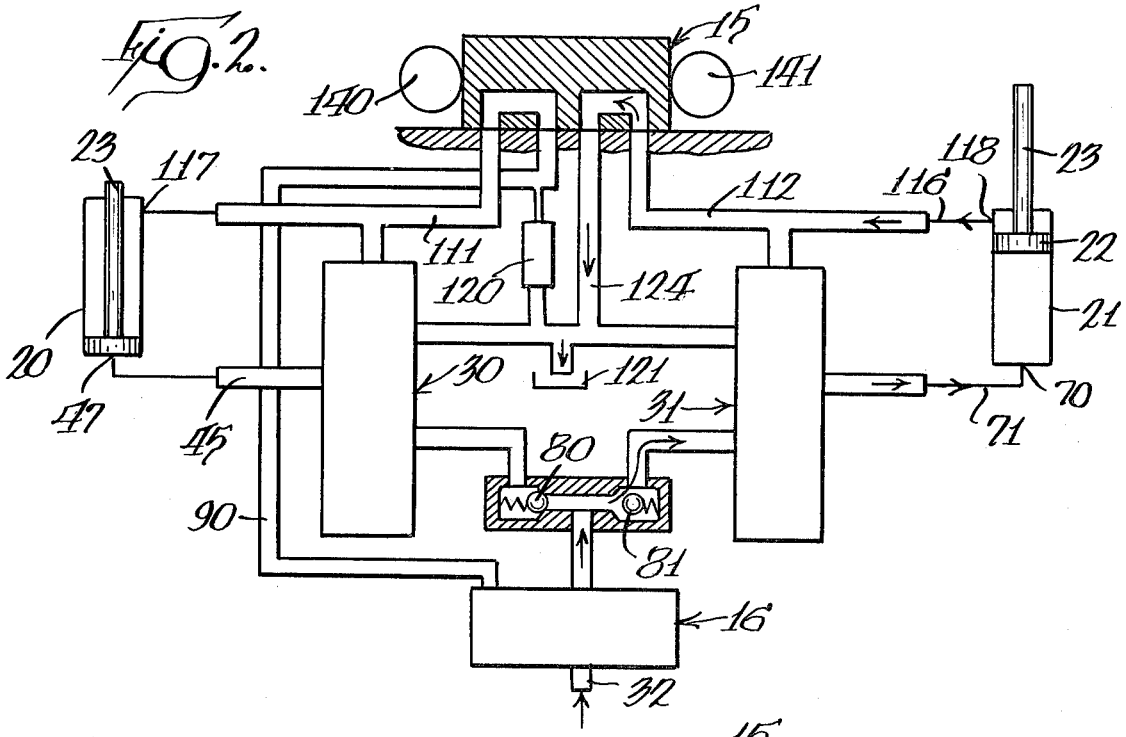
FIG. 2 is a schematic view, similar to FIG. 1, showing a different operative position of the valve structure and with certain major valve components shown in block form.

The operation for extending the piston 22 in cylinder 21 is shown in FIG. 2 wherein one of the solenoids 140 and 141 of the pilot valve has been energized to connect pilot line 112 to the reservoir line 124 while maintaining pilot line 111 connected to primary pilot line 90. The connection of pilot line 112 to tank relieves the pressure from pilot cylinder 61' whereby the springs 62' and 63' can lift the pilot piston 60' and the valve member 50'. This opens the inlet port 82' to the control port 44' whereby supply pressure can be directed to the extend port 70 of the cylinder 21. The poppet valve member 51' seats against the valve seat 42'. As the pilot pressure in the pilot line 90 builds up, the pressure-reducing valve has the valve stem 97 thereof moved to the right to close the pilot port 91 and pressure builds up in the outlet port 77 of the pressure-reducing valve dependent upon the work done by the piston in the cylinder 21 and, in an operative system, the pressure may build up to approximately 10,000 psi. This has no effect on the 3-way valve 30, because of the balanced condition in the position shown in FIG. 1, which is still the position of this valve in the circuit operation of FIG. 2.

Each of the 3-way valves has the valve seats 42 and 42' of a slightly larger diameter than the valve seats 43 and 43' whereby with either of the valve members in its upper position, the pressure existing at the control port results in an upward force tending to hold the valve member in its upper position because of the unbalanced areas subject to this pressure.

Figure 3:
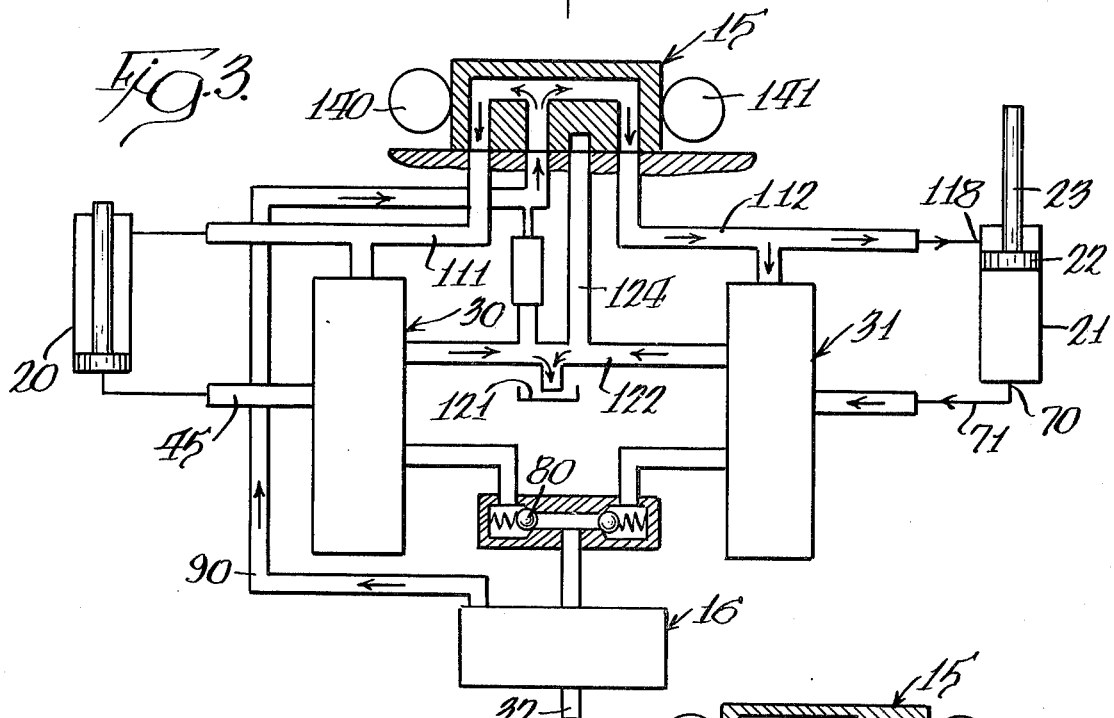
FIG. 3 is a view, similar to FIG. 2 and showing the parts positioned as in FIG. 1 in a different stage of operation.

When the pilot valve solenoid is deenergized, the pilot valve returns to the position of FIG. 1 and which is also the position of FIG. 3, wherein pilot pressure is again directed through pilot line 112 to the 3-way valve 31 as well as being maintained in the pilot line 111 leading to the 3-way valve 30. This results in the pilot piston 60' being lowered to return the valve member 50' to the position shown in FIG. 1 whereby the connection between the control port and the inlet port is blocked and the control port is connected to the reservoir port 123'. Pilot fluid flows to the retract port 118 of the cylinder 21 and there is flow from the extend port 70 to reservoir 121. This flow continues until the piston 22 returns to its fully retracted position, as shown in FIG. 1.

Figure 4:
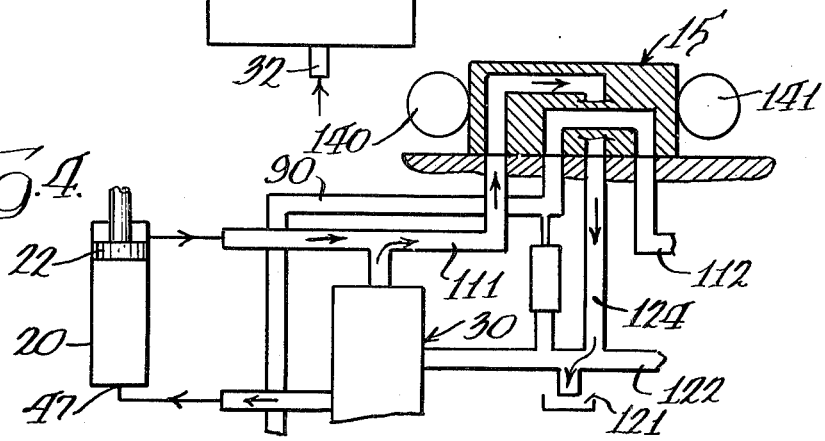
FIG. 4 is a fragmentary view, similar to FIG. 2, showing a third position of the pilot valve and the operation resulting therefrom.

The extension of the piston in the cylinder 20 is illustrated in FIG. 4 wherein the pilot valve 110 has been shifted to connect the pilot line 111 to the reservoir line 124. This relieves pilot pressure from the pilot cylinder 61, with the result that the pilot member 50 of the 3-way valve 30 can move upwardly to close off the valve seat 42 and connect the inlet port 82 to the control port 44. As described in connection with FIG. 2, supply pressure can then be delivered to the extend port 47 of the cylinder 20 and with fluid from the upper side of the piston 22 flowing to reservoir through the pilot line 111. During this operation, the cylinder 21 is not affected, since pilot line 112 continues to communicate with the primary pilot line 90. Retraction of the piston in the cylinder 20 occurs when the pilot valve 110 returns to the neutral position of FIG. 1 to again apply pilot pressure to the pilot piston 60.

I claim:

1. A pilot-operated double 4-way valve for controlling flow relative to a pair of cylinders each having an extend port and a retract port comprising, a pair of 3-way valves each having an inlet port, a control port connectable to a cylinder extend port, a port to reservoir, a bore and a poppet valve member movable therein, fluid circuit means for connecting said inlet ports to unidirectional flow from a high pressure fluid source, a pair of pilot pistons associated one with each valve member and operable for positioning of the valve member to cause the associated control port to connect to either the inlet port or the reservoir port, a low pressure fluid pilot circuit including a three-position pilot valve intermediate a primary pilot line and separate pilot lines to both of said pilot pistons, said pilot lines also connectable one to each of said cylinder retract ports, and means for positioning said pilot valve either in a first position to connect both pilot lines to said primary pilot line for directing pilot pressure to the pilot pistons and retract ports for positioning a piston in both cylinders in a retract position, in a second position to cause extension of the piston in one cylinder while the piston in the other cylinder remains retracted, or a third position to cause extension of the piston in the other cylinder while the piston in said one cylinder remains retracted.

2. A valve as defined in claim 1 including a fluid supply line with a pressure-reducing valve having a pair of outlets with one outlet connected to said primary pilot line and the other connected to said fluid circuit means.

3. A valve as defined in claim 1 including spring means associated with each valve member to urge the valve member to a position to close said reservoir port, and said pilot pressure acting on a pilot piston to shift the pilot piston and a valve member against the spring means to open said reservoir port and close said inlet port.

4. A pilot-operated double 4-way valve for controlling high pressure flow relative to a pair of cylinders each having an extend port and a retract port comprising, a pair of 3-way valves each having an inlet port, a control port connectable to a cylinder extend port, a port to reservoir, a bore with a pair of spaced-apart valve seats and a poppet valve member movable therein between said pair of valve seats, fluid circuit means for connecting said inlet ports to a high pressure fluid source, a pair of pilot pistons associated one with each valve member and operable for positioning of the valve member against one or the other of the valve seats to cause the associated control port to connect to either the inlet port or the reservoir port, a low pressure fluid pilot circuit including a three-position pilot valve intermediate a primary pilot line and a reservoir line and separate pilot lines to both of said pilot pistons, pilot pressure acting on a pilot piston to cause a valve member to connect a control port to a reservoir port, said pilot lines also connectable one to each of said cylinder retract ports, and means for positioning said pilot valve either in a first position to connect both pilot lines to said primary pilot line for directing pilot pressure to the pilot pistons to close said inlet ports and to the retract ports for positioning a piston in both cylinders in a retract position, in a second position to connect one pilot line to reservoir and cause extension of the piston in the cylinder associated with said one pilot line while the piston in the other cylinder remains retracted, or a third position to connect the other pilot line to reservoir and cause extension of the piston in the cylinder associated with said other pilot line.

5. A valve as defined in claim 4 wherein each of the valve members has a double frusto-conical shape and the diameter of the valve seat between the control port and the reservoir port is greater than the diameter of the valve seat between the control port and the inlet port.

6. A pilot-operated double 4-way valve usable in systems having fluid pressures approximating 10,000 psi for controlling flow relative to a pair of cylinders each having an extend port and a retract port comprising, a pair of 3-way valves each having an inlet port, a control port connectable to a cylinder extend port, a port to reservoir, a bore and a valve member movable therein, fluid circuit means including a pressure-reducing valve for connecting said inlet ports to a high pressure fluid source, a pair of pilot pistons associated one with each valve member and operable for positioning of the valve member to cause the associated control port to connect to either the inlet port or the reservoir port, a low pressure fluid pilot circuit including a three-position 4-way pilot valve having a port to reservoir and intermediate a primary pilot line and separate pilot lines to both of said pilot pistons, said primary pilot line being connected to a low pressure outlet of the pressure-reducing valve, said pilot lines also connectable one to each of said cylinder retract ports, and means for positioning said pilot valve either in a first position to connect both pilot lines to said primary pilot line for directing pilot pressure to the pilot pistons and retract ports for positioning a piston in both cylinders in a retract position, in a second position to connect one pilot line to reservoir and one pilot line to pilot pressure to cause extension of the piston in one cylinder while the piston in the other cylinder remains retracted, or a third position to reverse the last-mentioned connections of the pilot lines to cause extension of the piston in the other cylinder while the piston in said one cylinder remains retracted.

7. A pilot-operated, 4-way valve for controlling high pressure flow relative to a pair of control ports connectable one to a port of each of a pair of double-acting cylinders including; a pair of 3-way valves each having an inlet port, one of said control ports, a port to reservoir, a bore and a valve spool movable therein, a pair of spaced-apart valve seats positioned one between said control port and reservoir port and the other between said control port and the inlet port, and each of said valve spools having a poppet valve member engageable with one or the other of said last-mentioned seats and being balanced relative to pressure in the control port when closed against said other valve seat, a spring urging the poppet valve member toward said one valve seat; a pressure-reducing valve having a fluid supply port and first and second outlet ports with said first outlet port delivering pilot fluid, a valve spool with a poppet valve member for closing against a seat for blocking flow between said supply port and said first outlet port and being balanced relative to pressure in the second outlet port when said poppet valve member is closed; a passage connected to said second outlet port of the pressure-reducing valve and with two branches thereof connected one to each of the inlet ports of the 3-way valves for delivery of fluid to the inlet ports of said 3-way valves; a pair of check valves positioned one in each of said branch passages and blocking return fluid flow from the 3-way valves to the pressure-reducing valve; and a pilot control for said pair of 3-way valves including, a pilot control valve having an inlet connected to the first outlet port of the pressure-reducing valve, an outlet port to reservoir and a pair of outlet ports connected to a pair of pilot lines connected one to each of said pilot pistons, a pair of pilot pistons associated one with each 3-way valve and actuable by pilot fluid to move the valve spool of the associated 3-way valve away from said one seat thereof to connect a control port to reservoir and against said other seat to block said control port from the inlet port whereby fluid may flow through one of said check valves to the other of said 3-way valves which is against said one valve seat and to said control port, and a pair of ports connected one to each of said pilot lines and connectable one to another port of each of said pair of double-acting cylinders.

* * * * *